United States Patent [19]

Goldman

[11] Patent Number: 4,858,410

[45] Date of Patent: Aug. 22, 1989

[54] MODULAR BRICKWORK FORM

[76] Inventor: Robert I. Goldman, 6658 Cibola Rd., San Diego, Calif. 92120

[21] Appl. No.: 324,691

[22] Filed: Mar. 17, 1989

[51] Int. Cl.[4] ..... E04F 13/08

[52] U.S. Cl. ..... 52/592; 52/387; 52/593

[58] Field of Search ..... 52/387, 388, 389, 177, 52/747, 592, 593; 404/41, 42, 46

[56] References Cited

U.S. PATENT DOCUMENTS

| | | | |
|---|---|---|---|
| 2,329,610 | 9/1943 | Harman | 52/388 |
| 3,533,206 | 10/1970 | Passeno | 52/387 |
| 4,011,702 | 3/1977 | Matyas | 52/387 |
| 4,026,083 | 5/1977 | Hoyt | 52/387 |
| 4,436,779 | 3/1984 | Menconi | 52/177 |

*Primary Examiner*—John E. Murtagh

*Attorney, Agent, or Firm*—Charmasson & Holz

[57] ABSTRACT

A modular brickwork form for producing a regular pattern in brickwork construction. Raised ledges have concave and convex dimples to interconnect with adjoining forms, avoiding added space and deformation experienced by present day forms. The modulator brickwork form has a raised dividers and ledges to form a continuous pattern. The ledges have dimples to interconnect with adjoining modular forms without significant deformation. The lack of overlapping U-shaped edges also avoids added space between bricks and an irregular pattern of bricks. The raised ledges are also tapered to allow nesting of the forms when stacked. The forms may includes ports for drainage and corrugation for added strength.

9 Claims, 1 Drawing Sheet

MODULAR BRICKWORK FORM

FIELD OF THE INVENTION

This invention generally relates to the laying of bricks or concrete blocks More specifically the invention relates to forms which assist in the placement and laying, enabling unskilled personnel to produce an evenly spaced and satisfactory result.

BACKGROUND OF THE INVENTION

The primary objectives of a modular brickwork form are to: (1) provide a desired brickwork pattern (2) retain the patterned bricks in position prior to the cementing the patterned bricks; and (3) allow a variety of brickwork pattern applications. The modular form should be small and lightweight so that it can be easily handled and will not interfere with brickwork cementing or other construction activities. It should also be easily interconnectable, stackable for convenient storage, rugged in construction, pleasing in appearance and low in cost. It should also prevent weeds or other plants from growing between the bricks in the brickwork pattern. When the brickwork form is to be removed from storage and used, a minimum of placement time and effort is also desirable.

Without a form, brick laying requires that the bricks first be laid out to determine proper placement and arrangement. After verification, brick are then cemented. The use of a modular form dramatically speeds this laying process and assures a regular pattern.

Current brickwork forms may do some of these objectives well, but other objectives poorly or not at all. One approach uses lightweight plastic forms having regular patterns. The pattern is produced by raised U-shaped outer edges (rims) and dividers which also retain the bricks. This approach is illustrated in U.S. Pat. No. 4,026,083. Each brickwork form is then interlocked with other forms to adapt to the specific size of the application. Specific sizes may also be accommodated by cutting a form to edge or size limitations.

However, this approach is not without problems. These prior art brickwork forms tend to be cumbersome, limiting storage, transport, access, interconnection and use. If stacked they do not nest, causing added storage and transport space and cost. If a large area is to be bricked over, the user may not be able to carry the forms required, adding still further to costs and time.

These prior U-shaped approaches have many other limitations. These are primarily related to the modular edges and interlocking elements required accomodate various sizes. The U-shaped edges are "slightly wider" in some configurations and encroach upon brick space in adjoining forms. This both interferes with brick regular placement and require tolerances resulting in a more irregular pattern. The U-shaped edge also must be deformed to interlock with adjoining forms, requiring a semi-rigid construction, typically a bendable lightweight plastic. They are not easily adaptable to complex patterns or those blocks having curvilinear edges. These U-shaped edges cause added time, cost, weight and space. This added time, weight and space particularly detract from the reliability of the desired pattern.

None of the prior art cited incorporates a means for interconnecting modules without added space or significant deformation of the form. The added space and deformation alters the regular brickwork pattern and may cause unacceptable quality and cementing of the finished brickwork.

What is needed is a modular brickwork form which is both stackable and allows convenient interconnections without added space or significant deformation of the forms. Stackability and consistent spacing will improve the reliability of the finished product and lower construction costs.

SUMMARY OF THE INVENTION

The principal and secondary objects of the invention are:

to provide a regular pattern form for brickwork;

to provide an interlocking means which does not interfere with the regular pattern; and to provide an interconnecting means which does not significantly deform the pattern.

These and other objects are achieved by a modular brickwork form having a raised ledge. The ledge has dimples to interconnect with adjoining modular forms without significant deformation. The lack of overlapping U-shaped edges also avoids added space between bricks and an irregular pattern of bricks. The raised ledges are also tapered to allow nesting of the forms when stacked.

DESCRIPTION OF THE PREFERRED EMBODIMENT

Figure 1:
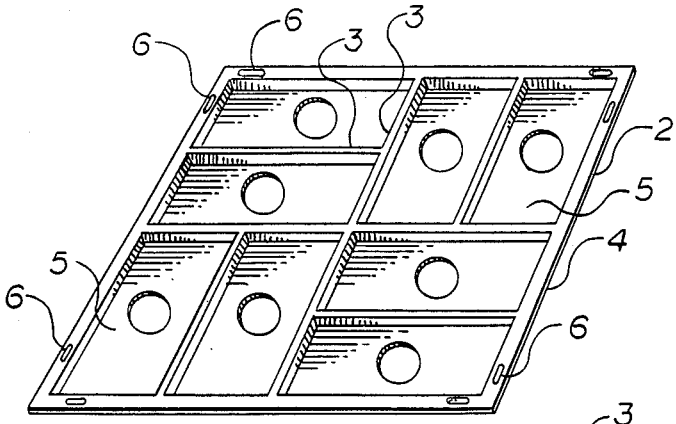
FIG. 1 shows a perspective view of a modular brickwork form.

FIG. 1 shows the preferred embodiment of the brickwork form 2. The form 2 is generally planar and composed of a plastic or other lightweight moldable sheet material. Raised dividers 3 and raised edges 4 retain locks (see FIG. 3) in recesses 5, when the blocks are placed within these recesses 5. The sheet form is divided into eight recesses in an alternating paired pattern of bricks. Other embodiments would provide different patterns, numbers and sizes of recesses for various brick or block patterns.

The edges also contain notches or indented dimples 6. Although all four raised edges contain dimples, only adjoining dimpled edges (see FIG. 3) are required. The dimples 6 are concave up/convex down depressions on the edge 4. The shape ad location of the dimples, raised dividers and edges allow nesting of the forms when stacked (see FIG. 4). The notches or dimples are also placed to overlap and nest within adjoining dimples (see FIG. 3).

Figure 2:
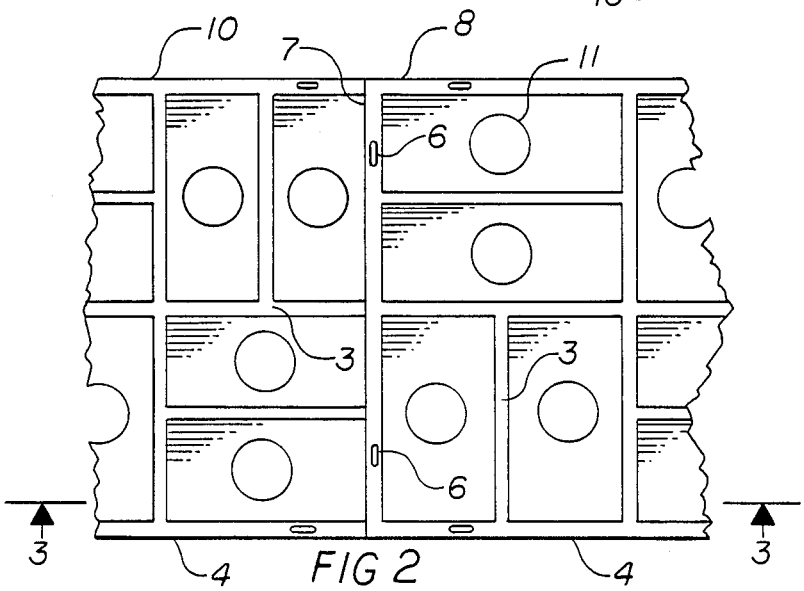
FIG. 2 shows a top view of a adjoining modular brickwork forms.

FIG. 2 is a top view of adjoining modular brickwork forms 2. A first edge 7 of first form 8 overlaps a second edge 9 (see FIG. 3) of a second form 10. Dimples 6 on the first edge 7 nest within the dimples 6 on the second edge 9 (see FIG. 3). The first and second edges of adjoining forms 8 and 10 may be at slightly different elevations to fully eliminate deformation, or the edges 7 and 9 may be flexible.

The forms 7 and 9 also contain apertures or holes 11 for drainage of excess water during construction. Dividers 3 and other edges 4 are again raised to retain bricks or blocks on adjoining forms (see FIG. 3).

Figure 3:
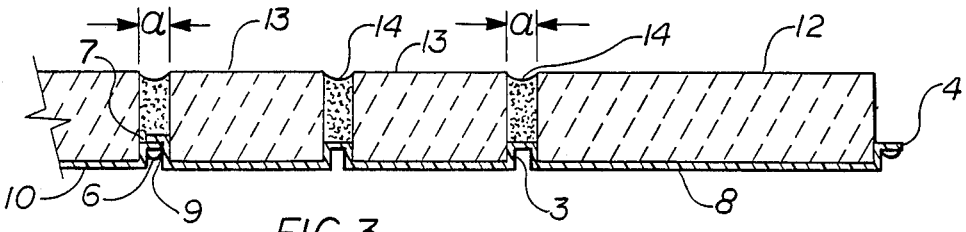
FIG. 3 shows a cross-sectioned view of the adjoining modular brickwork forms.

FIG. 3 a cross sectioned view as shown in FIG. 2 of bricks or blocks 12 retained in adjoining forms 8 and 10. The pattern places a pair 13 of rectangular bricks 12 adjoining other brick pairs rotated 90 degrees from the first pair. Raised dividers 3 and edges 4 retain the bricks 12 in specific locations with the desired pattern. The first edge 7 of the first form 8 overlaps the second edge 9 of the second form 10. As shown the first edge 7 is slightly higher than the second edge 9. In addition the length of the edges is slightly smaller than the dividers to equally space the bricks 12 in the desired pattern. Cement 14 attaches adjoining bricks in a equally spaced apart pattern. Equal spaces "a" are formed by adjoining edges 4 and dividers 3. The overlapping edges form a barrier to weeds and other growth when the forms are placed on the ground.

Figure 4:
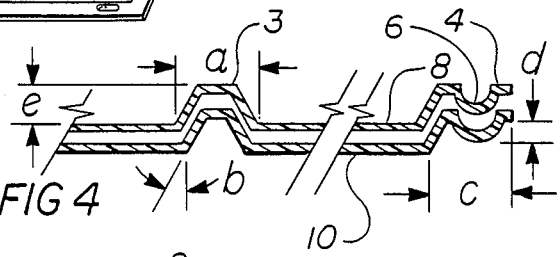
FIG. 4 shows the forms nested when stacked for storage.

FIG. 4 shows a portion of the forms nested when stacked for storage. First form 8 is placed on top of second form 10. Dividers 6 provide a spacing "a" between bricks (see FIG. 3). The divders and dimpled edges 4 are tapered by an angle "b" to allow nesting when stacked. The edge dimension "c" is slightly smaller than "a" and is selected to provide a spaced apart dimension "a" between adjoining bricks when first form 8 is placed on top of the second form 10. The depth "d" of dimples 6 is a function of the need to retain adjoining forms If the forms are to be laid out on a flat horizontal surface, the dimples function only as locators, requiring a nominal projection into the adjoining edge. The depth "d" of the preferred embodiment in this case is less than 3 cm (0.125 inches) in comparison to the overall raised edge dimension "e" which is approximately 9 cm (0.375 inches).

Other embodiments can be formed of more rigid materials which support the bricks at other than horizontal patterns. Edges can also be designed to interconnected by abutting projections instead of overlapping projections (dimples). If the edges 4 are flexible, dimension "c" would be altered so that the adjoining deformed edges would still produce the spaced apart dimension "a" (see FIG. 3). The sheet form may also be corrugated to improve load carrying capability. In still alternate embodiments, the ledges and dividers can be separated from the base sheet of the forms. Dividers and edges can also be curvilinear to match similarly shaped blocks and bricks.

While the preferred embodiment of the invention has been shown and described, and some alternate embodiments also shown and described, changes and modifications may be made therein within the scope of the appended claims without departing from the spirit and scope of this invention.

What is claimed is:

1. A plurality of forms for laying a pattern of blocks comprising:

at least two symmetrical planar bases each commensurate with a plurality of said blocks arranged in said pattern and having edges corresponding to a portion of the perimeters of said blocks;

a plurality of raised dividers on each of said bases, said dividers shaped and dimensioned to retain and space apart said blocks at specific locations on said bases;

a first raised ledge along a first edge of each of said bases;

a second raised ledge along a edge of each of said bases, said second edge being opposite to said first edge across each of said bases;

protruding means for locating adjoining forms attached to said first ledge; and receiving means for locating adjoining forms attached to said second ledge, wherein said protruding means is shaped and dimensioned to engage said receiving means, wherein both of said means for locating are generally commensurate and comprise at least one notch located on said first ledge having one convex surface, and at least one matching notch located on said second edge having one concave surface.

2. The device claimed in claim 1, wherein said raised dividers and ledges on one of said bases are tapered and dimensioned to generally nest within corresponding dividers and ledges on another one of said sheets when said sheets are stacked.

3. The device claimed in claim 2, wherein said bases also comprise apertures.

4. The device claimed in claim 3, wherein said bases are corrugated.

5. The device claimed in claim 4, wherein each of said forms retain 4 blocks and said dividers comprise two intersecting tapered ridges dividing said base into four smaller areas having at least one side retaining one side of one of said blocks.

6. The device claimed in claim 5, wherein said dividers also comprise four subdividers, one subdivider located in each of said smaller areas, said subdividers joining the mid-points of two opposite sides of each of said smaller areas.

7. The device claimed in claim 6, wherein said notches on said first ledge comprises a convex dimple and said matching notch on said second edge comprises a matching convex dimple.

8. The device claimed in claim 7, wherein said ledges have a specific raised ledge dimension and are generally planar, wherein said notches protrude a first dimension from said ledges, wherein said first dimension is less than one half the raised ledge dimension.

9. The device claimed in claim 8, wherein said ledges have a major dimension and said notches extend along said ledges a second dimension, wherein the sum of said second dimensions is less than one half said major dimension.

* * * * *